US009671200B1

(12) United States Patent
Anderson et al.

(10) Patent No.: US 9,671,200 B1
(45) Date of Patent: Jun. 6, 2017

(54) KINETIC AIR DEFENSE

(71) Applicant: NORTHROP GRUMMAN SYSTEMS CORPORATION, Falls Church, VA (US)

(72) Inventors: Mark A. Anderson, Torrance, CA (US); John P. Latz, Valencia, CA (US); Michael Ichino, Gardena, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 15/092,537

(22) Filed: Apr. 6, 2016

(51) Int. Cl.
*F41H 11/02* (2006.01)
*F41G 7/22* (2006.01)
*F41G 7/30* (2006.01)

(52) U.S. Cl.
CPC ..... *F41H 11/02* (2013.01); *F41G 7/2213* (2013.01); *F41G 7/2286* (2013.01); *F41G 7/2293* (2013.01); *F41G 7/308* (2013.01)

(58) Field of Classification Search
USPC ..... 89/37.16, 37.17, 37.19, 1.54, 1.55, 1.56
See application file for complete search history.

(56) References Cited

U.S. PATENT DOCUMENTS 2,709,947 A * 6/1955 Woods ..... B64D 7/02 244/113
3,088,404 A * 5/1963 Brown ..... F42B 12/58 102/393
4,307,650 A 12/1981 Kuesters et al.
4,697,764 A 10/1987 Hardy et al.
6,196,496 B1 3/2001 Moskovitz et al.
6,929,214 B2 8/2005 Ackleson et al.
6,980,151 B1 12/2005 Mohan
7,093,798 B2 8/2006 Whelan et al.
7,114,428 B1 10/2006 Lloyd
7,137,599 B1 * 11/2006 Sitzmann ..... B64D 7/08 244/137.4
7,377,217 B2 5/2008 Swanson
7,378,626 B2 5/2008 Fetterly
(Continued)

OTHER PUBLICATIONS

Hackett, Willy, Wing Commander et al. Stealth, Sensor Fusion, Situational Understanding and Precision Attack: Is This the Right Answer to Balance of Force? Air Power, Rush Defense Systems Jun. 2010, pp. 50-55.

(Continued)

*Primary Examiner* — Stephen M Johnson
(74) *Attorney, Agent, or Firm* — John A. Miller; Miller IP Group, PLC

(57) ABSTRACT

A missile defense system on an aircraft for destroying threats to the aircraft. The defense system includes at least one miniature guided missile mounted in a launch tube on the aircraft, where the guided missile includes a target acquisition and seeker system. The system also includes at least one sensor on the aircraft for acquiring a target threat, and a controller on the aircraft receiving signals from the at least one sensor. The controller generates a fire control solution that is provided to the at least one guided missile that directs the guided missile once it is fired from the launch tube towards the target threat, and the seeker system on the guided missile acquires the target once it is launched from the aircraft so as to destroy the target.

17 Claims, 2 Drawing Sheets

(56) References Cited

U.S. PATENT DOCUMENTS

| | | | | |
|---|---|---|---|---|
| 7,494,090 | B2 | 2/2009 | Leal et al. | |
| 7,506,841 | B2 | 3/2009 | Duden et al. | |
| 7,523,692 | B1 | 4/2009 | Burns | |
| 8,049,656 | B2 | 11/2011 | Shani et al. | |
| 8,205,536 | B2 | 6/2012 | Fisher | |
| 8,281,697 | B2 | 10/2012 | McCants, Jr. | |
| 8,376,277 | B2 | 2/2013 | Costanza et al. | |
| 8,809,755 | B1 | 8/2014 | Patel et al. | |
| 2010/0326264 | A1* | 12/2010 | Roemerman | B64D 1/06 89/1.56 |
| 2014/0102288 | A1* | 4/2014 | Yeshurun | F41H 5/007 89/36.17 |
| 2016/0047628 | A1* | 2/2016 | Kolanek | F41G 7/007 701/7 |

OTHER PUBLICATIONS

Alkire, Brien et al. "Applications for Navy Unmanned Aircraft Systems" Report Document, 2010, 66 pgs.

* cited by examiner

KINETIC AIR DEFENSE

BACKGROUND

Field

This invention relates generally to a mini self-defense missile (MSDM) system provided on an aircraft for destroying incoming threats and, more particularly, to an MSDM system provided on a high performance military aircraft that includes miniature precision guided missiles provided outside of a main weapons bay on the aircraft, where the system identifies and tracks potential incoming threats and deploys the guided miniature missiles to destroy the threats.

Discussion

Air superiority is an important aspect of modern day warfare, and can generally be obtained in a number of ways including aircraft stealth, precision weapons, advanced targeting technologies, etc. Modern day US tactical aircraft have been successful in countering enemy missiles through various technologies, such as shooting out chaff from the aircraft, towing decoys behind the aircraft, shooting flares from the aircraft, etc., all of which are intended to confuse or draw away the incoming missile threat. However, the ability to operate largely uncontested in a particular air space as a result of these and other capabilities has been continually eroded over time, where the capability to track and defeat missile threats is decreasing. Further, exclusive reliance on even higher levels of reduced observability will be insufficient to ensure unfettered freedom of operation in the future.

Technologies for engaging incoming missile threats using kinetic weapons that track the target is generally known in the art. More particularly, defense systems exist in the art that are able to acquire, track and engage offensive missiles intending to destroy ground-based targets. For example, the patriot missile system is a ground-based kinetic defense system that is able to acquire incoming missiles through radar detection and fire a patriot interceptor missile to engage the incoming missile threat, which is equipped with a missile guidance system. Course correction commands are transmitted to the missile guidance system from the ground-based defense system. A target acquisition system on the missile acquires the target and transmits acquisition data to the controller for further course correction calculations.

DETAILED DESCRIPTION OF THE EMBODIMENTS

The following discussion of the embodiments of the invention directed to a mini self-defense missile (MSDM) system is merely exemplary in nature, and is in no way intended to limit the invention or its applications or uses. For example, the MSDM system will be discussed herein in connection with a high performance military aircraft. However, as will be appreciated by those skilled in the art, the MSDM system may have application for any airborne platform, such as bombers, tankers, helicopters, corporate jets, etc.

The present invention proposes an anti-missile kinetic defense system deployable on an aircraft that includes a plurality of "mini" guided munitions or missiles employed solely for defensive purposes and fireable from one or more missile pods positioned on the aircraft, where the missile pods are separate from the main offensive weapons bay on the aircraft. The kinetic defense system can use sensors already available on the aircraft for object and threat detection. The missiles that are fired from the pod are guided to the incoming target threat so that the threat is destroyed at a safe distance from the aircraft.

Figure 1:
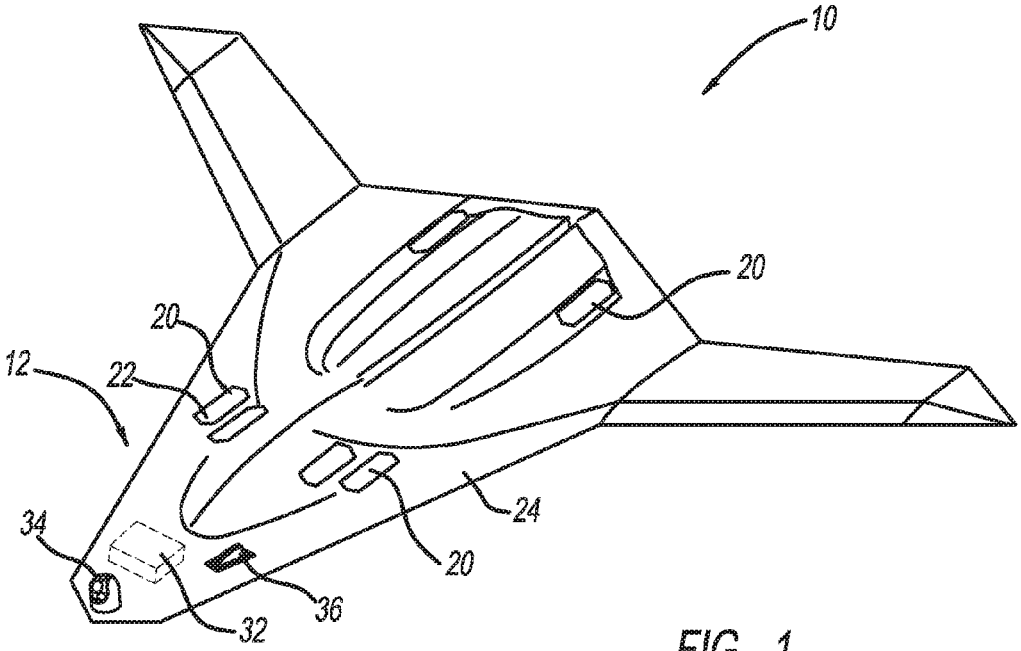
FIG. 1 is a top isometric view of a conceptual design for a high performance military aircraft including a mini self-defense missile (MSDM) system.
Figure 2:
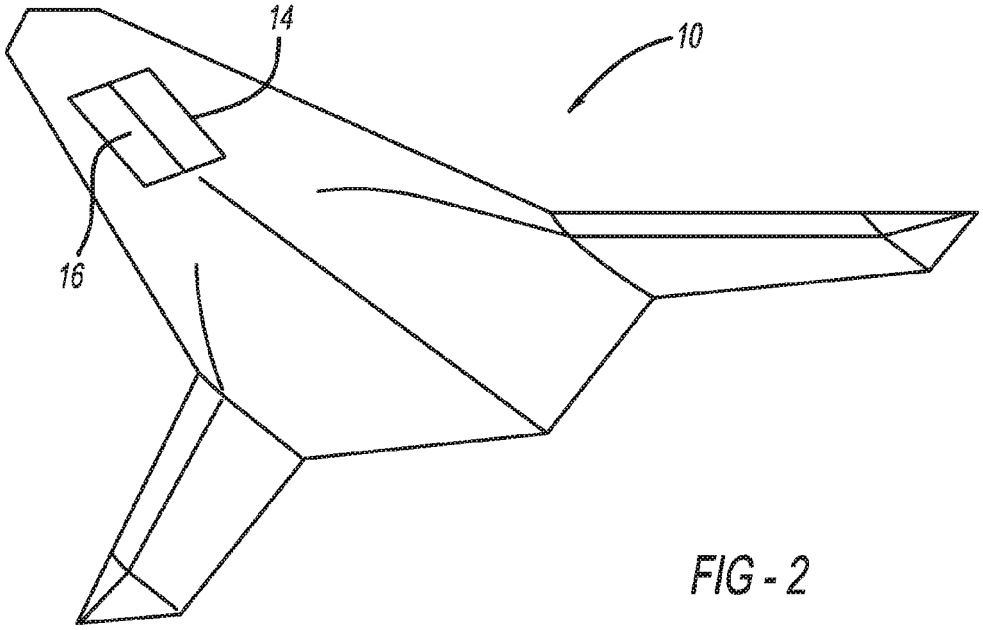
FIG. 2 is a bottom isometric view of the aircraft shown in FIG. 1.

FIG. 1 is a top isometric view and FIG. 2 is a bottom isometric view of an aircraft 10 including an MSDM system 12 of the type referred to above. In this non-limiting embodiment, the aircraft 10 is a conceptual futuristic fighter aircraft used solely to illustrate the invention as discussed herein. However, as will be appreciated by those skilled in the art, the MSDM system 12 can be deployable on other types of aircraft, including bombers, non-tactical aircraft, helicopters, etc. The aircraft 10 is an offensive military aircraft and includes a number of offensive weapons for engaging enemy targets both on the ground and in the air. Some or all of those offensive weapons are deployable or fired from a main weapons bay 14 on an underside of the aircraft 10 when weapons bay doors 16 are open in a manner well known in the art.

The MSDM system 12 is a defensive kinetic weapons system that employs miniature precision guided munitions or missiles that are fired from the aircraft 10 to destroy incoming missiles or other objects intended to destroy the aircraft 10. The MSDM system 12 includes a plurality of missile pods 20 located at various locations on the aircraft 10. In this non-limiting example, the aircraft 10 includes six of the pods 20, although any number of the missile pods 20 may be applicable for the particular aircraft. Each of the pods 20 is shown in its retracted position on the aircraft 10 in FIG. 1, where an outer panel 22 of the pod 20 is generally flush with an outer skin 24 of the aircraft 10.

Figure 3:
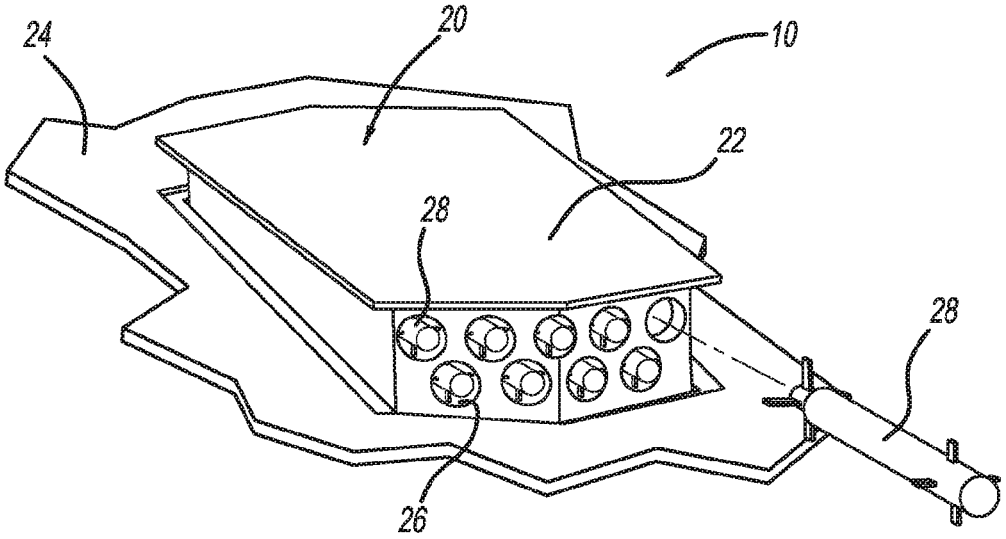
FIG. 3 is a cut-away isometric view of a portion of the aircraft shown in FIG. 1 illustrating a missile pod including a plurality of miniature guided missiles that are part of the MSDM system.

FIG. 3 is a cut-away isometric view of a portion of the aircraft 10 showing one of the pods 20 in its deployed position, where it extends some distance up from the aircraft skin 24. The pod 20 includes a number of missile launch tubes 26, here nine, where each launch tube 26 holds at least one, and possibly more, guided miniature "mini" missiles 28. One of the guided missiles 28 is shown after it has been fired from one of the launched tubes 26 consistent with the discussion herein. The pod 20 can be a fixed structure, such as be hanging from a pylon, or can be deployed from and retractable into the aircraft 10 in any suitable manner, as would be well understood by those skilled in the art. It is stressed that the manner in which the pod 12 is deployed, the number of the launch tubes 26, the number of the missiles 28, the size of the missiles 28, the configuration of the launch tubes 26, etc. would be specific to the particular application.

The system 12 includes a controller 32 for controlling the acquisition of the potential target and launching of the missiles 28. As mentioned above, the MSDM system 12 uses existing sensors on the aircraft 10 to detect incoming missile threats, and then launches the guided missiles 28 from the pods 20 to intercept and destroy the incoming missile target. In one embodiment, for example, an optical cueing sensor 34 on the aircraft 10 identifies an incoming target threat in a general location approaching the aircraft 10, and then a radar tracking sensor 36 tracks the target threat in response to a cue from the optical cueing sensor 34. Alternately, the tracking sensor could be an optical sensor.

Figure 4:
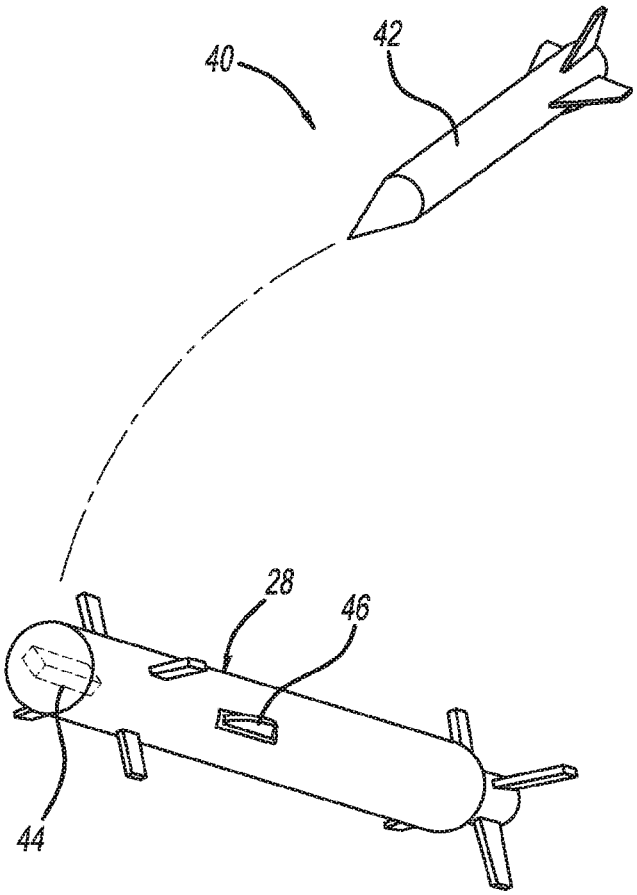
FIG. 4 is an isometric view showing one of the missiles illustrated in FIG. 3 targeting an incoming missile threat.

FIG. 4 is an illustration 40 showing one of the missiles 28 after it has been launched from the aircraft 10 and being guided to destroy a target missile 42. The missile 28 includes a suitable on-board guidance and seeker system 44 that acquires the target missile 42. The present invention anticipates that any suitable guidance system, such as an RF guidance system, an infrared guidance system, a semi-active laser guidance system etc., can be employed for guiding the missile 28 towards the target missile 42 once the target missile 42 has been detected and the missile 28 has been launched. Once the radar sensor 36 is able to track the target missile 42, the controller 32 provides a fire control solution that is downloaded into the missile 28 to be fired. The missile 28 is then fired from the pod 20, and the onboard seeker system 44 is initiated to acquire the target missile 42 after it has made flight corrections to be directed to the target missile 42 in a manner well understood by those skilled in the art. The seeker system 44 will obtain the target missile 42 and then using suitable sensors 46, such as RF radar sensors, will track and home in on the target missile 42 to ultimately destroy it.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A missile defense system on an aircraft for destroying threats to the aircraft, said defense system comprising:

at least one guided missile mounted in a launch tube on the aircraft, said guided missile including a target acquisition and seeker system;

at least two sensors on the aircraft for acquiring a target, including a cueing sensor and a tracking sensor, where the cueing sensor identifies the target and the tracking sensor tracks the target; and a controller on the aircraft responsive to signal from the at least ene two sensors, said controller generating a fire control solution that is provided to the at least one guided missile that directs the guided missile once the guided missile is fired from the launch tube towards the target, wherein the seeker system on the guided missile acquires the target once the guided missile is launched from the aircraft so as to destroy the target.

2. The defense system according to claim 1 wherein the at least one guided missile is a plurality of guided missiles.

3. The defense system according to claim 2 wherein at least some of the plurality of guided missiles are combined as a group of guided missiles on a common launch platform.

4. The defense system according to claim 3 wherein the plurality of guided missiles are on multiple launch platforms.

5. The defense system according to claim 3 wherein the launch platform is extendable and retractable relative to an aircraft outer surface.

6. The defense system according to claim 1 wherein the at least one guided missile is provided on the aircraft outside of a main offensive weapons bay on the aircraft.

7. The defense system according to claim 1 wherein the cueing sensor is an optical sensor and the tracking sensor is a radar sensor.

8. The defense system according to claim 1 wherein the cueing sensor and the tracking sensor are optical sensors.

9. The defense system according to claim 1 wherein the at least one guided missile is deployable for defensive purposes only.

10. The defense system according to claim 1 wherein the target is an offensive missile.

11. The defense system according to claim 1 wherein the aircraft is a military fighter aircraft.

12. A missile defense system on a military fighter aircraft for destroying incoming missile threats to the aircraft, said defense system comprising:

a plurality of precision guided missiles mounted in a plurality of launch tubes, where the plurality of launch tubes are part of one or more launch platforms deployable on the aircraft, each guided missile including a target acquisition and seeker system;

at least two sensors on the aircraft for acquiring a target missile, including an optical cueing sensor and a radar tracking sensor, where the cueing sensor identifies the target missile and the tracking sensor tracks the target missile; and a controller on the aircraft responsive to signals from the at least two sensors, said controller generating a fire control solution that is provided to at least one of the guided missile that directs the guided missile once the guided missile is fired from the launch tube towards the target missile, wherein the seeker system on the guided missile acquires the target missile once the guided missile is launched from the aircraft so as to destroy the target missile.

13. The defense system according to claim 12 wherein the one or more launch platforms are extendable and retractable relative to an aircraft outer surface.

14. The defense system according to claim 12 wherein the guided missiles are provided on the aircraft outside of a main offensive weapons bay on the aircraft.

15. A missile defense system on a military fighter aircraft for destroying incoming missile threats to the aircraft, said defense system comprising:

a plurality of precision guided missiles mounted in a plurality of launch tubes, where the plurality of launch tubes are part of one or more launch platforms deployable on the aircraft, each said guided missile including a target acquisition and seeker system, wherein the guided missiles are provided on the aircraft outside of a main offensive weapons bay on the aircraft, and wherein the launch platform is extendable and retractable relative to an aircraft outer surface;

at least two sensors on the aircraft for acquiring a target missile, including an optical cueing sensor and a radar tracking sensor, where the cueing sensor identifies the target missile and the tracking sensor tracks the target missile; and a controller on the aircraft responsive to signals from the at least two sensors, said controller generating a fire control solution that is provided to at least one of the guided missile that directs the guided missile once the guided missile is fired from the launch tube towards the target missile, wherein the seeker system on the guided missile acquires the target missile once the guided missile is launched from the aircraft so as to destroy the target missile.

16. The defense system according to claim 15 wherein at least some of the plurality of guided missiles are combined as a group of guided missiles on a common launch platform.

17. The defense system according to claim 16 wherein the plurality of guided missiles are on multiple launch platforms.

* * * * *